US007008352B2

(12) United States Patent
Grossi

(10) Patent No.: US 7,008,352 B2
(45) Date of Patent: Mar. 7, 2006

(54) TREADMILL FOR PERFORMING PHYSICAL EXERCISE HAVING SIMPLIFIED ACTUATION MEANS

(75) Inventor: Massimiliano Grossi, Rome (IT)

(73) Assignee: EGO S.R.L., Rome (IT)

( * ) Notice: Subject to any disclaimer, the term of this patent is extended or adjusted under 35 U.S.C. 154(b) by 0 days.

(21) Appl. No.: 10/808,555

(22) Filed: Mar. 25, 2004

(65) Prior Publication Data

US 2004/0198559 A1 Oct. 7, 2004

(30) Foreign Application Priority Data

Apr. 7, 2003 (EP) ..... 03425217

(51) Int. Cl.
*A63B 22/02* (2006.01)

(52) U.S. Cl. ..... 482/54; 482/52

(58) Field of Classification Search ..... 482/51–54
See application file for complete search history.

(56) References Cited

U.S. PATENT DOCUMENTS 767,221 A * 8/1904 Hagen ..... 482/54
4,579,335 A 4/1986 Centafanti
5,100,127 A 3/1992 Melnick et al.
5,279,528 A 1/1994 Dalebout et al.
5,411,455 A * 5/1995 Haber et al. ..... 482/54
5,462,504 A * 10/1995 Trulaske et al. ..... 482/7
5,558,605 A 9/1996 Gvoich
5,626,539 A * 5/1997 Piaget et al. ..... 482/54
5,690,587 A * 11/1997 Gruenangerl ..... 482/54
5,879,270 A * 3/1999 Huish et al. ..... 482/8
2001/0051564 A1 12/2001 Alexander et al.

FOREIGN PATENT DOCUMENTS

DE 92 18 435 U 3/1994
GB 382 340 A 10/1932

* cited by examiner

*Primary Examiner*—Jerome W. Donnelly
*Assistant Examiner*—Tam Nguyen
(74) *Attorney, Agent, or Firm*—Albert Josif; Daniel O'Byrne

(57) ABSTRACT

A treadmill for performing physical exercise, comprising, on a supporting frame, a belt that winds continuously around a main roller and a free roller; elements for varying the inclination of the supporting frame which are driven by the motion of the belt produced by the energy supplied by the user being also provided.

11 Claims, 5 Drawing Sheets

TREADMILL FOR PERFORMING PHYSICAL EXERCISE HAVING SIMPLIFIED ACTUATION MEANS

The present invention relates to a treadmill for performing physical exercise, having simplified actuation means.

BACKGROUND OF THE INVENTION

As is known, already commercially available treadmills are generally constituted by a belt that runs continuously around a free roller and a driving roller that is associated with motor means for imparting the selected travel speed to the belt.

Although these embodiments have proved to be valid in many respects, they have been found to be susceptible of improvements especially as regards constructive simplicity and as regards the possibility to tilt the belt gradually and steplessly during sports exercise without requiring the athlete to step off the treadmill or interrupt his pace.

SUMMARY OF THE INVENTION

The aim of the invention is to solve the problems described above, by providing a treadmill that allows to combine with the conventional characteristics of the classic treadmill the possibility to adapt easily to the various kinds of use, therefore being usable by people of any age, with or without athletic preparation.

Within this aim, an object of the invention is to provide a treadmill that allows the user to reach the intended exercise speed very rapidly without having to provide an electric power supply for the treadmill.

Another object of the present invention is to provide a treadmill that by way of its particular constructive characteristics is capable of giving the greatest assurances of reliability and safety in use.

Another object of the present invention is to provide a treadmill that can be obtained easily starting from commonly commercially available elements and materials and is further competitive from a merely economical standpoint.

This aim and these and other objects that will become better apparent hereinafter are achieved by a treadmill for performing physical exercise, having simplified actuation means, according to the invention, characterized in that it comprises, on a supporting frame, a belt that winds continuously around a main roller and a free roller, actuation means being further provided for varying the inclination of said supporting frame, said actuation means being driven by the motion of said belt produced by the energy supplied by the user.

BRIEF DESCRIPTION OF THE DRAWINGS

Further characteristics and advantages of the invention will become better apparent from the description of a preferred but not exclusive embodiment of a treadmill for performing physical exercise, having simplified actuation means, illustrated by way of non-limitative example in the accompanying drawings, wherein.

DESCRIPTION OF THE PREFERRED EMBODIMENTS

Figure 1:
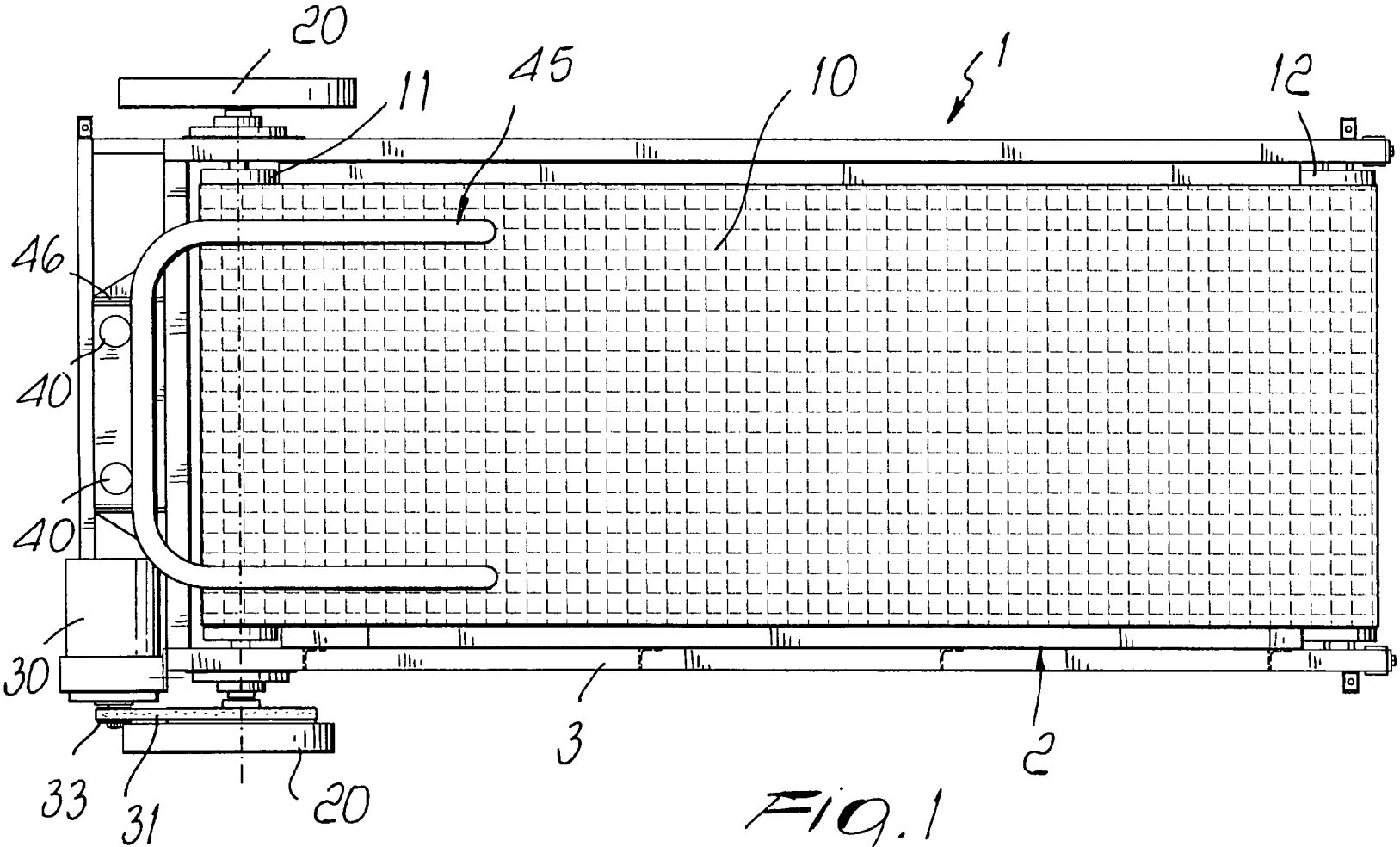
FIG. 1 is a top plan view of the treadmill according to the invention.
Figure 2:
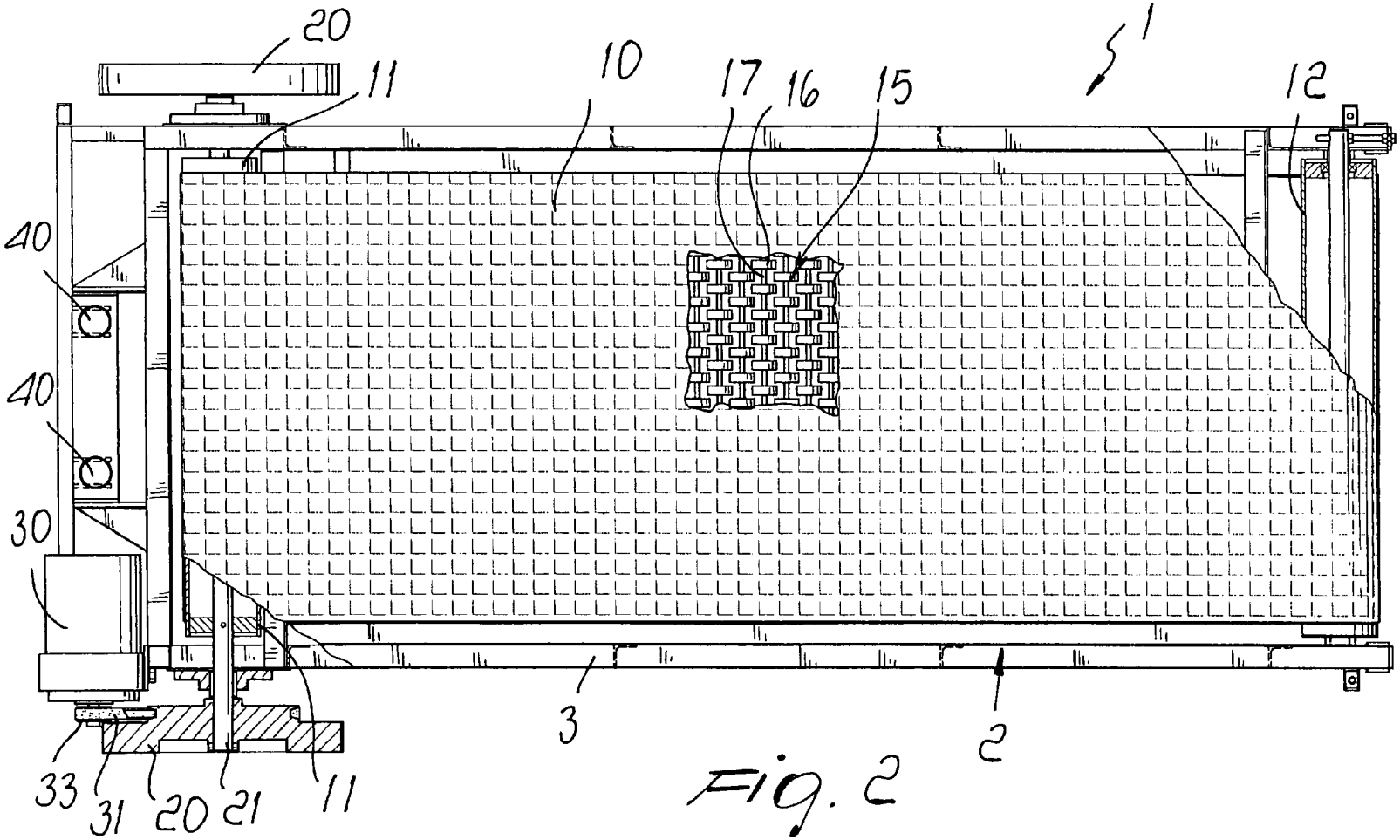
FIG. 2 is a partially cutout plan view of the treadmill, illustrating its components.
Figure 3:
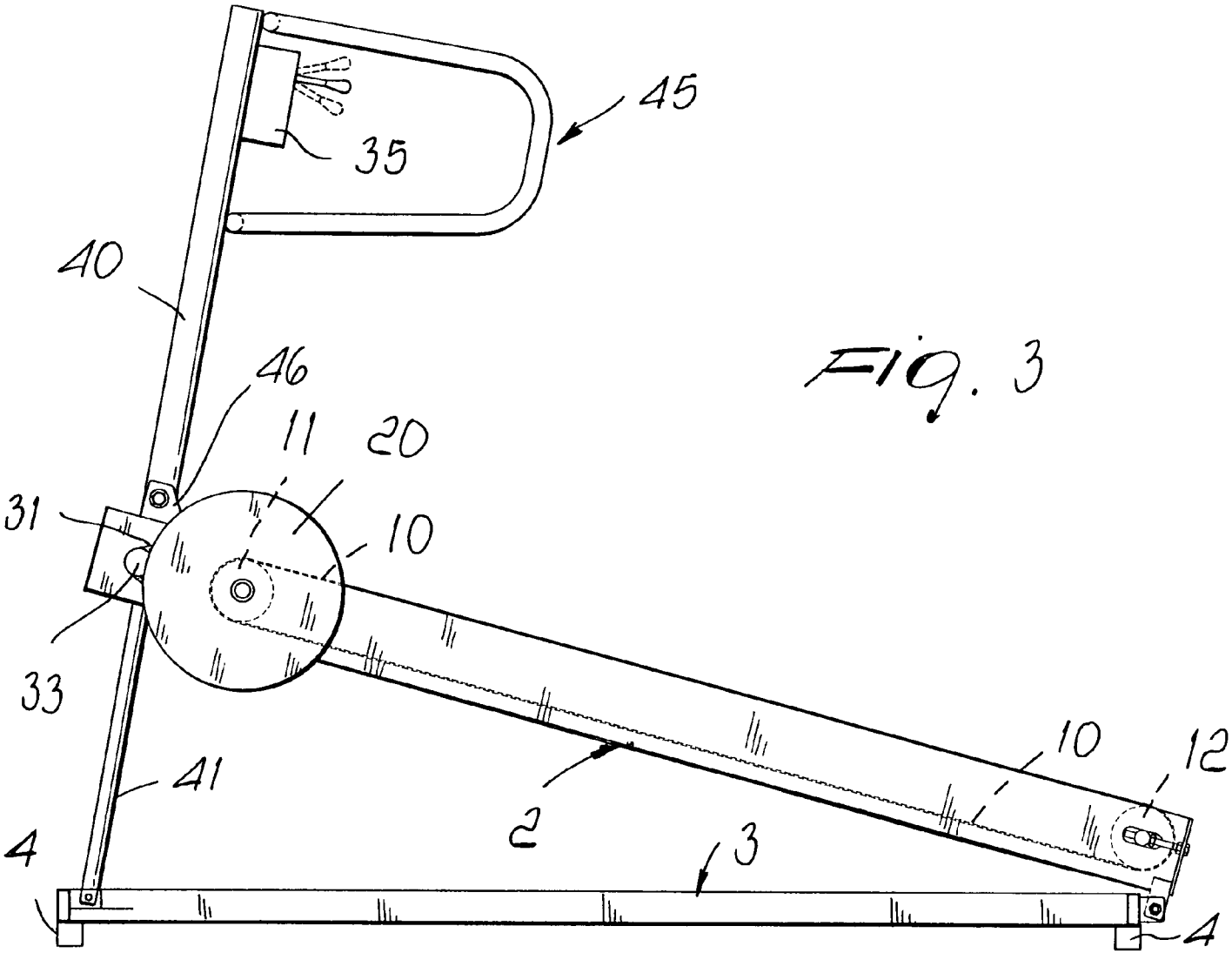
FIG. 3 is a schematic side elevation view of the treadmill in a raised position.
Figure 4:
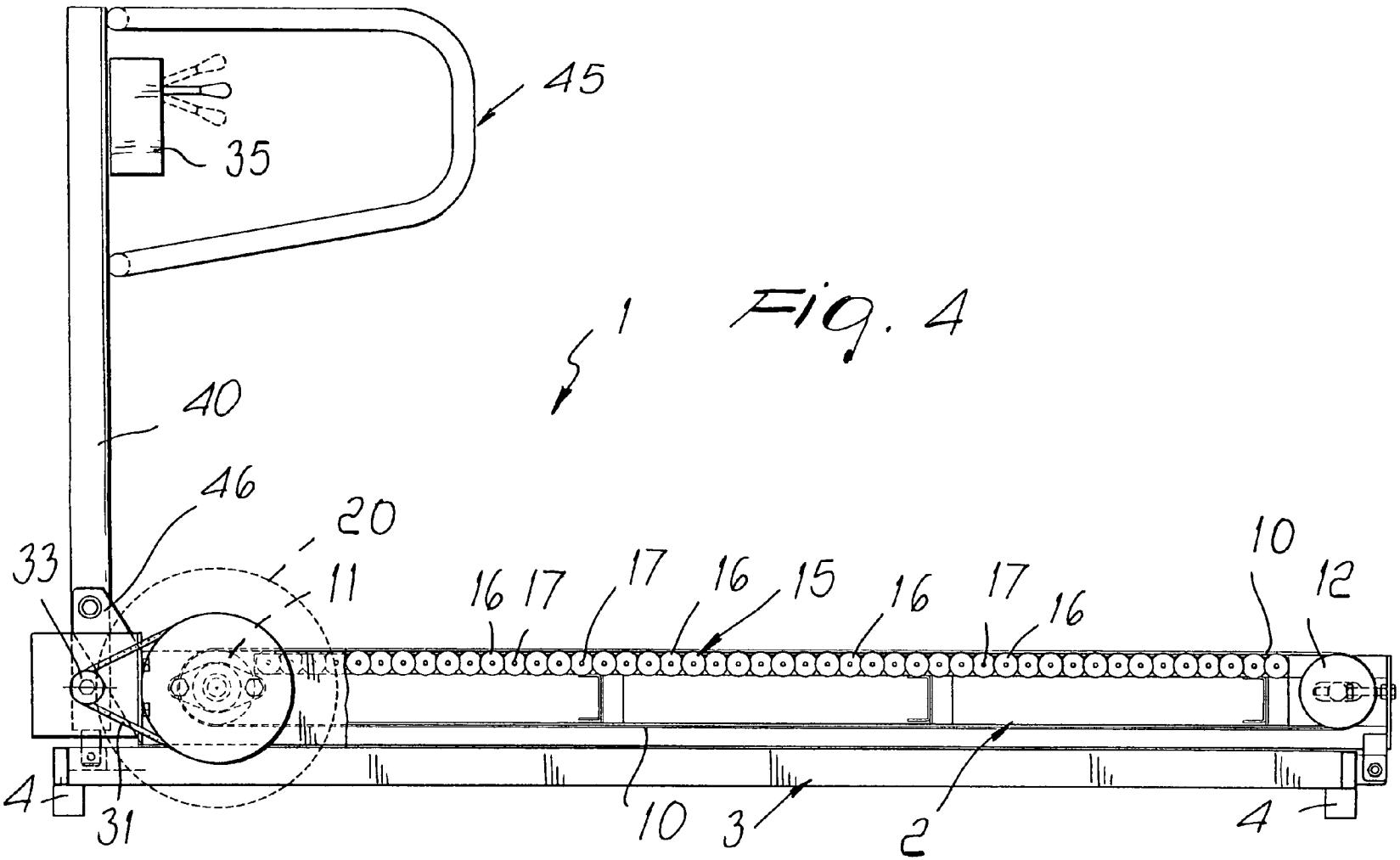
FIG. 4 is a schematic sectional view of the treadmill, taken along a longitudinal central plane.
Figure 6:
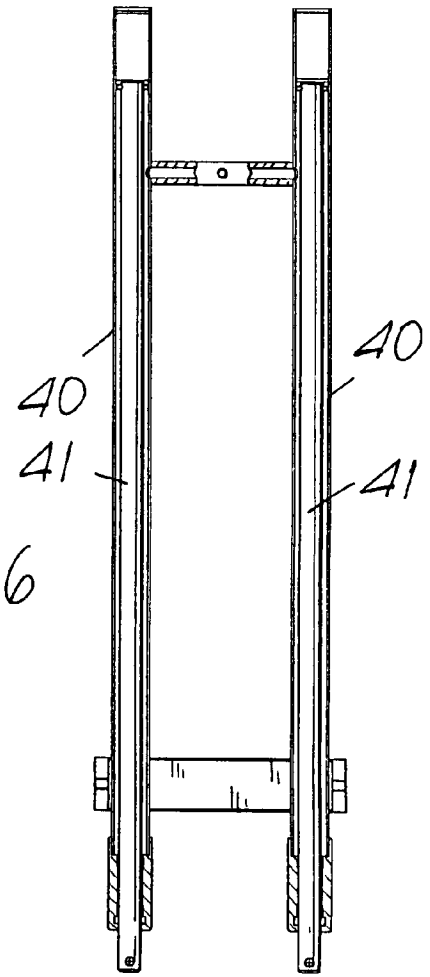
FIG. 6 is a front view of the means for varying the inclination of the supporting frame.
Figure 5:
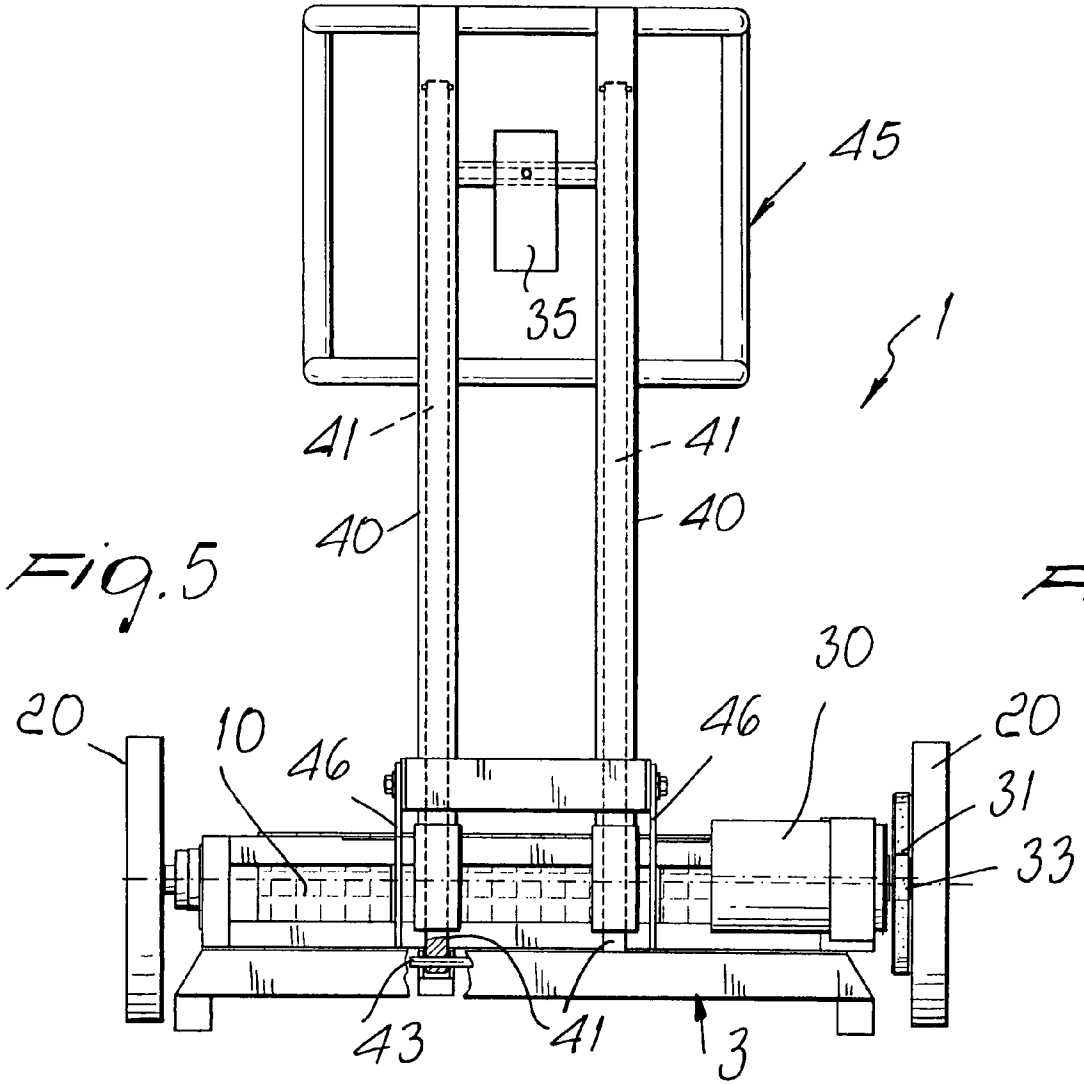
FIG. 5 is a front view of the treadmill.

With reference to the figures, the treadmill for performing physical exercise, having simplified actuation means, according to the invention, generally designated by the reference numeral 1, comprises a supporting frame 2, which preferably has a substantially rectangular elongated shape and which, at one end which is referenced as rear end, is pivoted to a base frame 3, which is also substantially rectangular and is advantageously provided with resting feet 4.

The supporting frame 2 supports a belt 10 that winds continuously around a main roller 11 arranged at the front and a free roller 12 arranged at the rear.

At the upper portion of the belt 10 there is a low-friction surface, generally designated by the reference numeral 15, which is advantageously provided by means of a plurality of rollers 16 supported so that they can rotate freely on shafts 17 that are connected to the supporting frame 2.

Advantageously, the rollers 16 are staggered so as to form a relatively continuous supporting surface for the user's feet; it is obviously also possible to use other kinds of supporting surface, such as for example a plurality of long rollers arranged side by side or other solutions capable of ensuring adequate mutual sliding of the belt and the surface 15.

At the main roller 11 there are flywheels 20, which are keyed to the shaft 21 of the main roller and are designed to give uniformity to the motion both at constant speed and during acceleration and deceleration.

An important particularity of the invention consists in that means are provided for varying the inclination of the supporting frame, which are driven directly by the advancement of the belt 10 produced by the energy supplied by the user.

In greater detail, such means provide motor means, advantageously constituted by a hydraulic pump 30, which draws its motion from a belt 31 that is connected to a pulley-like portion formed on one of the flywheels 20 and engages a driven pulley 33 that is keyed to the shaft of the pump.

The pump 30, with a distribution unit 35 interposed, supplies hydraulic cylinders, designated by the reference numeral 40, which are connected to a front frame 45 that is pivoted, so as to allow oscillation about an axis that is substantial parallel to the axis of the main roller with brackets 46 formed on the supporting frame 2.

The pistons 41 that slide in the cylinders 40 are pivoted, at their lower end, at the front portion of the base frame 3, advantageously by means of pins 43 that can be removed easily.

The distribution unit 35 is designed to regulate the flow of oil delivered by the pump so as to direct it toward discharge into an appropriately provided reservoir during the normal use of the belt or feed it into the lifting cylinders 40 when one wishes to vary the inclination of the belt; the pressurized oil fed directly by the pump actuated by the energy of the user who is on the belt in fact causes the pistons 41 to extend, consequently increasing the inclination.

The distribution unit 35 further allows the oil to return to the reservoir if one wishes to return the belt to a position that is substantially proximate to the horizontal arrangement.

It should be added to the above that it is optionally possible to provide, between the driven pulley 33 and the pump body 30, an optional clutch system that allows to reduce friction whenever the upward movement for varying the inclination of the belt is not required.

It is optionally possible to use a centrifugal clutch coupling that is interposed between the driven pulley and the pump actuation shaft in order to free the belt from the friction produced by the rotation of the hydraulic pump, thus allowing the belt to slide more freely especially in the initial steps.

In practical operation, when the user decides to change the inclination of the belt, by acting on the distribution unit 35, he can send the oil pressurized by the pump toward the cylinders 40, thus achieving the extension of the pistons and the consequent lifting of the belt, whose supporting frame 2 is pivoted to the base frame 3.

With the described arrangement, the user can therefore vary the inclination directly from the deck, without being forced to step off, and can instead change the inclination while moving.

It should also be added to the above that it is optionally possible to reduce space occupation simply by extracting the pins 43, thus allowing to fold the front frame onto the belt.

The invention thus conceived is susceptible of numerous modifications and variations, all of which are within the scope of the appended claims.

All the details may further be replaced with other technically equivalent elements.

Thus, for example, it is possible to replace the hydraulic pump with other means, for example mechanical means, that allow to lift the belt by using directly the energy imparted by the user.

In practice, the materials used, so long as they are compatible with the specific use, as well as the contingent shapes and dimensions, may be any according to requirements.

The disclosures in EPA No. 03425217.1 from which this application claims priority are incorporated herein by reference.

What is claimed is:

1. A treadmill for performing physical exercise having simplified actuation means, comprising, a supporting frame, a belt that winds continuously around a main roller and a free roller, actuation means being further provided for varying inclination of said supporting frame, said actuation means being driven by the winding motion of said belt produced by energy supplied by a user, said means for varying the inclination of the frame comprising motor means that are actuated by the winding motion of said belt, and hydraulic cylinder means connected to said supporting frame and controlled by said motor means for varying the inclination of said supporting frame.

2. The treadmill according to claim 1, wherein said supporting frame has opposite ends, said supporting frame being pivoted to a base frame at one of said opposite ends.

3. The treadmill according to claim 1, wherein said supporting frame has a low-friction surface around which said belt rotates.

4. The treadmill according to claim 3, wherein said low-friction surface is constituted by a plurality of rollers supported so that they can rotate freely on shafts connected to said supporting frame.

5. The treadmill according to claim 4, wherein said rollers are substantially staggered.

6. The treadmill according to claim 3, wherein said low-friction surface is constituted by a plurality of long rollers arranged side by side.

7. The treadmill according to claim 1, further comprising, at said main roller, flywheels that are keyed to a rotation shaft of said main roller.

8. The treadmill according to claim 7, wherein said motor means comprise a hydraulic pump that is connected, by means of a belt, to a pulley-like portion that is formed on one of said flywheels, said belt winding around a driven pulley that is keyed to a shaft of said pump.

9. The treadmill according to claim 8, wherein said hydraulic cylinder means comprise hydraulic cylinders that are connected to said pump with a distribution unit interposed, said hydraulic cylinders being pivoted to said supporting frame so that they can oscillate about an axis that is substantially parallel to the axis of said main roller, the pistons of said cylinders being pivoted to said base frame.

10. The treadmill according to claim 9, wherein said distribution unit is adapted to adjust a flow of oil delivered by said pump in order to discharge the oil during normal use and to send the oil to said lifting cylinders in order to vary the inclination.

11. The treadmill according to claim 9, comprising removable pins, for connecting said pistons to said base frame, that are removed in order to fold said treadmill.

* * * * *